US009204494B2

(12) United States Patent
Lafleur

(10) Patent No.: US 9,204,494 B2
(45) Date of Patent: Dec. 1, 2015

(54) HYBRID HEATER ASSEMBLY WITH HEATING ELEMENTS HAVING DIFFERENT WATTAGE DENSITIES

(71) Applicant: General Electric Company, Shelton, CT (US)

(72) Inventor: Robert Jules Lafleur, Louisville, KY (US)

(73) Assignee: General Electric Company, Schenectady, NY (US)

( * ) Notice: Subject to any disclaimer, the term of this patent is extended or adjusted under 35 U.S.C. 154(b) by 427 days.

(21) Appl. No.: 13/692,045

(22) Filed: Dec. 3, 2012

(65) Prior Publication Data

US 2014/0151364 A1 Jun. 5, 2014

(51) Int. Cl.

| | |
|---|---|
| ***F25D 21/08*** | (2006.01) |
| ***H05B 3/10*** | (2006.01) |
| ***H05B 1/02*** | (2006.01) |

(52) U.S. Cl.

CPC ..... *H05B 1/028* (2013.01); *F24F 2221/34* (2013.01); *H05B 2203/005* (2013.01); *H05B 2203/037* (2013.01)

(58) Field of Classification Search

None

See application file for complete search history.

(56) References Cited

U.S. PATENT DOCUMENTS

| | | | | | |
|---|---|---|---|---|---|
| 2,250,691 | A | * | 7/1941 | Wilson et al. | 392/375 |
| 2,833,905 | A | * | 5/1958 | Kenny | 219/202 |
| 2,978,568 | A | * | 4/1961 | Murphy | 392/436 |
| 3,235,709 | A | * | 2/1966 | Fischer | F24C 15/105 219/448.15 |
| 3,275,069 | A | * | 9/1966 | Kelly | 165/64 |
| 3,610,882 | A | * | 10/1971 | Omohundro | 392/376 |
| 3,799,245 | A | * | 3/1974 | Ferdelman | 165/265 |
| 3,951,625 | A | | 4/1976 | Follette | |
| 4,667,086 | A | * | 5/1987 | Keefe | 219/532 |
| 4,759,189 | A | | 7/1988 | Stropkay et al. | |
| 4,841,127 | A | * | 6/1989 | Prager et al. | 219/225 |
| 4,912,300 | A | * | 3/1990 | Hennuy et al. | 392/365 |
| 5,289,084 | A | | 2/1994 | Nuckolls et al. | |
| 5,571,432 | A | | 11/1996 | Sarbach | |
| 5,761,908 | A | * | 6/1998 | Oas et al. | 62/3.2 |
| 6,035,097 | A | * | 3/2000 | Behrendt et al. | 392/380 |
| 6,355,915 | B1 | * | 3/2002 | Ziaimehr et al. | 219/486 |
| 6,658,882 | B2 | * | 12/2003 | Ohama et al. | 62/262 |
| 6,965,731 | B2 | * | 11/2005 | Huang et al. | 392/373 |
| 8,309,894 | B2 | * | 11/2012 | Zimmer et al. | 219/552 |
| 8,993,936 | B2 | * | 3/2015 | Lafleur | 219/480 |
| 2003/0062362 | A1 | * | 4/2003 | Tateishi | 219/508 |
| 2004/0089653 | A1 | * | 5/2004 | Tazawa | 219/548 |
| 2006/0018640 | A1 | * | 1/2006 | Hinesley | 392/420 |
| 2006/0263073 | A1 | * | 11/2006 | Clarke et al. | 392/347 |

(Continued)

FOREIGN PATENT DOCUMENTS

| | | | |
|---|---|---|---|
| JP | 59095333 | A | 6/1984 |
| JP | 2010234253 | A | 10/2010 |

OTHER PUBLICATIONS

US Office Action issued in connection with related case U.S. Appl. No. 13/692,040 dated Jul. 31, 2014.

*Primary Examiner* — Joseph M Pelham

(74) *Attorney, Agent, or Firm* — Dority & Manning, P.A.

(57) ABSTRACT

A heater assembly in an air conditioning unit includes one or more first heating elements characterized by a first wattage density, and one or more second heating elements characterized by a second wattage density. The second wattage density is greater than the first wattage density. The one or more second heating elements are interspersed with the one or more first heating elements.

16 Claims, 3 Drawing Sheets

(56) References Cited

U.S. PATENT DOCUMENTS

2007/0187076 A1* 8/2007 Martinus et al. ..... 165/135
2011/0062145 A1* 3/2011 Yang et al. ..... 219/538
2011/0198340 A1 8/2011 Zimmer et al.
2012/0312029 A1 12/2012 Brehm et al.

* cited by examiner

HYBRID HEATER ASSEMBLY WITH HEATING ELEMENTS HAVING DIFFERENT WATTAGE DENSITIES

CROSS-REFERENCE TO RELATED APPLICATION

The present application is related to concurrently filed U.S. application Ser. No. 13/692,040 (now U.S. Pat. No. 8,993,936) and entitled "Hybrid Heater Assembly," the disclosure of which is incorporated herein by reference.

BACKGROUND OF THE INVENTION

The subject matter disclosed herein relates to heaters, and more particularly to heaters used in air conditioning units.

Current air conditioning units such as package terminal heat pump (PTHP) units and package terminal air conditioner (PTAC) units are known to use a ceramic heater to provide electric heating within the unit. The ceramic heater in such units is known to have a positive temperature coefficient (PTC) of resistance, and is thus known as a PTC heater. The types of ceramics used in PTC heaters include, but are not limited to, barium titanate and lead titanate composites. The ceramic heater may be used for a room heating function (e.g., in the PTHP unit) and for a unit defrost function (e.g., in the PTAC unit).

While the PTC heater provides benefits such as lower wattage density and self-regulation, which are favorable for safety purposes, the PTC heater is susceptible to wattage degradation over the life of the heater. It has been proposed in the U.S. patent application entitled "Triac Control of Positive Temperature Coefficient (PTC) Heaters in Room Air Conditioners," Ser. No. 12/704,816, filed Feb. 12, 2010, the disclosure of which is incorporated by reference herein, to slowly ramp up the heat output of a PTC heater, using a triac control methodology, to help minimize the wattage degradation effect over the life of the heater. This gradual heat up of the PTC heater, which can take up to several minutes to reach a full heat output level, may not be desirable to some users.

BRIEF DESCRIPTION OF THE INVENTION

As described herein, the exemplary embodiments of the present invention overcome one or more disadvantages known in the art.

In one embodiment, a heater assembly comprises: one or more first heating elements, the one or more first heating elements being characterized by a first wattage density; and one or more second heating elements, the one or more second heating elements being characterized by a second wattage density, the second wattage density being greater than the first wattage density. The one or more second heating elements are interspersed with the one or more first heating elements.

In another embodiment, an air conditioning unit comprises a heater assembly comprising: one or more first heating elements, the one or more first heating elements being characterized by a first wattage density; and one or more second heating elements, the one or more second heating elements being characterized by a second wattage density, the second wattage density being greater than the first wattage density. The one or more second heating elements are interspersed with the one or more first heating elements.

In one further embodiment, the one or more first heating elements are ribbon heaters and the one or more second heating elements are coil heaters, the ribbon heaters having a lower wattage density than the coil heaters.

Advantageously, using a combination of coil heaters and ribbon heaters within one heater assembly allows a user to realize the "instant on" benefits of the coil heaters and the ribbon heaters, and the lower wattage density and safety benefits of the ribbon heaters. In particular, the lower wattage density of the ribbon heaters serves to spread the heat output of the heat assembly over a larger airflow surface area than would otherwise be the case in a heater assembly with coil heaters only. Additionally, since PTC heaters are eliminated, there is no need for triac ramp-up control of the PTC heaters.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

One or more of the heater assembly embodiments of the invention will be described below in the context of an air conditioning unit, such as a commercial air conditioning unit. However, it is to be understood that heater assembly embodiments of the invention are not intended to be limited to air conditioning units. Rather, heater assembly embodiments of the invention may be applied to and deployed in any other suitable environment in which it would be desirable to improve heating functions and to reduce the costs associated with manufacturing and/or operating the heater assembly.

Figure 1:
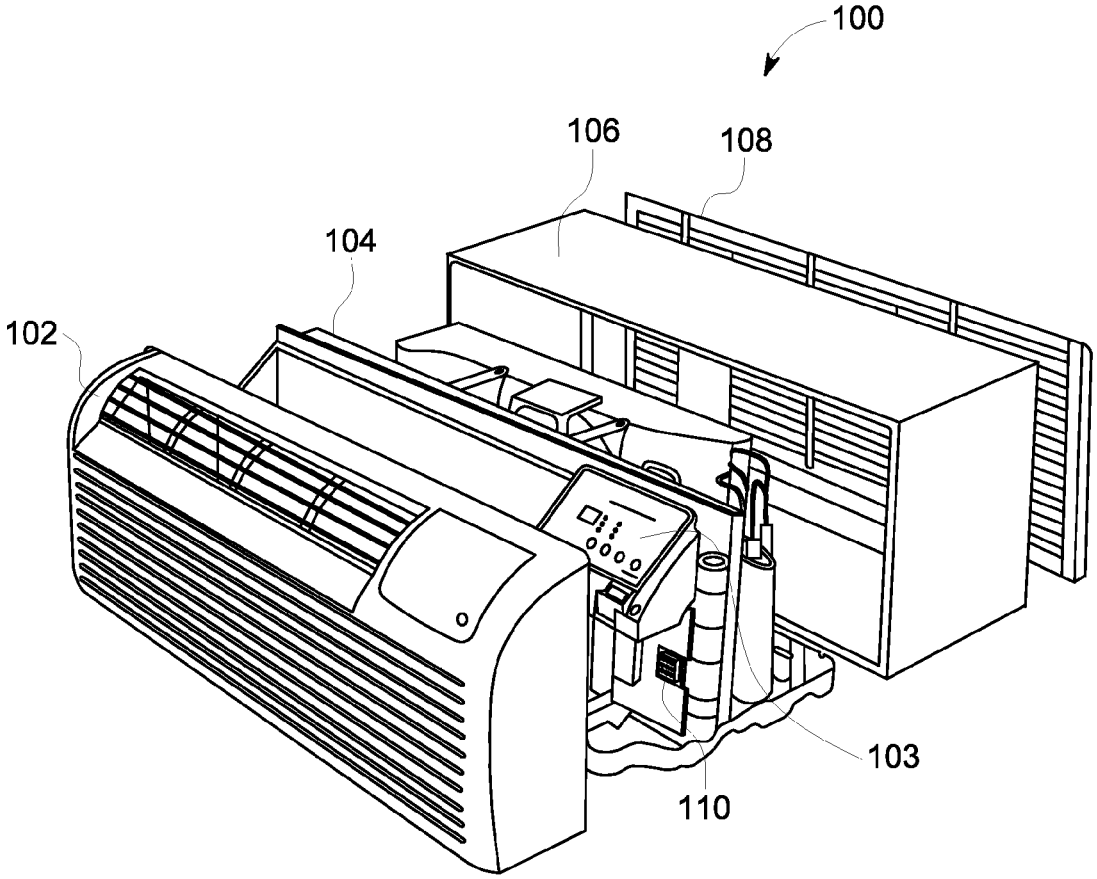
FIG. 1 is a diagram of an air conditioning unit, in accordance with an embodiment of the invention.

FIG. 1 is an exploded diagram of an air conditioning unit, in accordance with an embodiment of the invention. More particularly, FIG. 1 illustrates an exemplary air conditioning unit 100 within which a hybrid heater assembly according to an embodiment of the invention may be deployed. The air conditioning unit 100 may, for example, be a package terminal heat pump (PTHP) unit or a package terminal air conditioner (PTAC) unit, which are commercial units available from General Electric Company (Fairfield, Conn.) as part of their Zoneline® product line. However, it is to be understood that embodiments of the invention are not limited to use in such specific air conditioning units or in air conditioning units generally, as mentioned above.

As generally shown in FIG. 1, air conditioning unit 100 comprises a room cabinet 102, a chassis 104, a wall sleeve 106, and an outside grille 108. In the context of a commercial unit (such as may be installed in a hotel room; although this could be a household unit as well), the unit is installed through an outside wall of the room such that the room cabinet 102 is accessible in the room, and such that a user control panel 103 is accessible within the room for a user to control the cooling/heating functions of the unit.

The wall sleeve 106 passes through a wall of the room, and the grille 108 is on the outside of the room (outdoors). The chassis 104 comprises the electronics, heating and cooling components and assemblies associated with the air conditioning unit 100. A universal power connector 110, which will be described further below, provides electrical power connections for the unit 100 to be powered by a power source (not shown) of the building in which the unit is deployed.

Heater assembly embodiments of the invention may be part of chassis 104. Since the present application is directed to heater assemblies, the other components and assemblies of the air conditioning unit 100 are not further described herein unless to facilitate a further understanding of the heater assembly embodiments.

Figure 2:
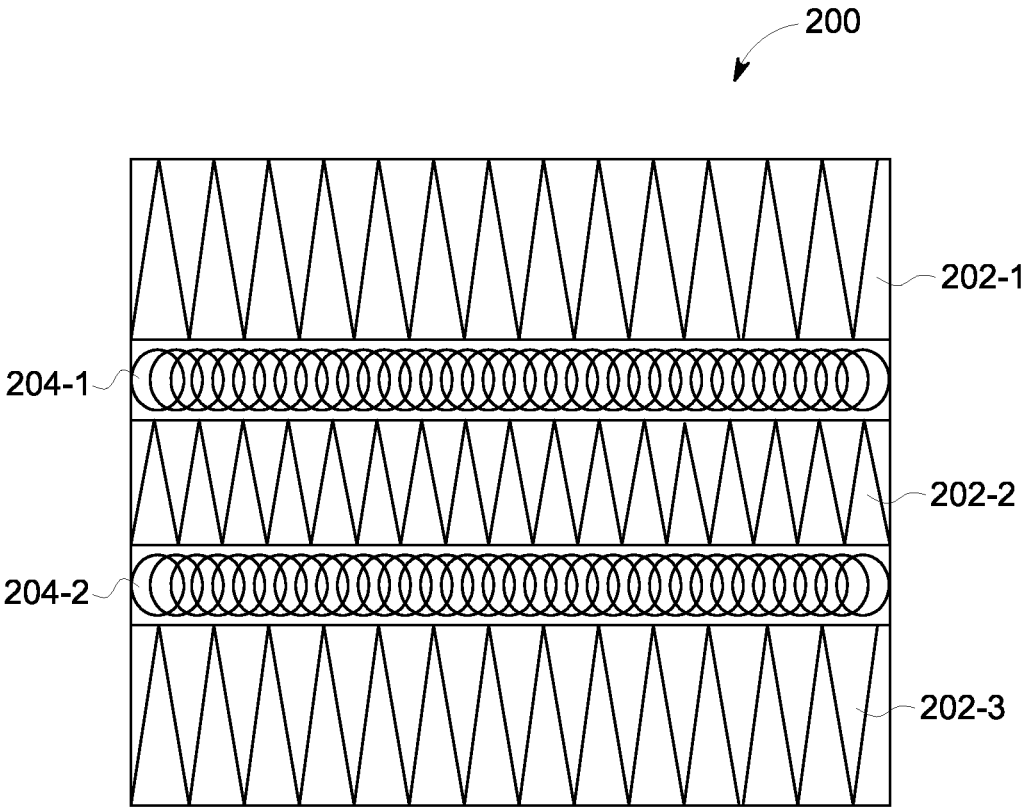
FIG. 2 is a diagram of a hybrid heater assembly, in accordance with an embodiment of the invention.

FIG. 2 is a schematic diagram of a hybrid heater assembly 200, in accordance with an embodiment of the invention. As mentioned above, the hybrid heater assembly 200 in FIG. 2 may be mounted in the chassis 104 of air conditioning unit 100 shown in FIG. 1.

As shown, hybrid heater assembly 200 comprises ribbon heating elements (heaters) 202-1, 202-2 and 202-3. Interspersed with the ribbon heaters 202-1, 202-2 and 202-3 are coil heating elements (heaters) 204-1 and 204-2. The coil heaters 204-1 and 204-2 may be resistance heating elements, including non-magnetic alloy heating elements formed from nichrome. One skilled in the art will appreciate that other materials may be used in place of nichrome. The ribbon heaters 202-1, 202-2 and 202-3 may be resistance heating elements, including non-magnetic alloy heating elements formed from nichrome. As illustrated in FIG. 2, the ribbon heaters are configured in a relatively open, zig-zag configuration. The coil heaters are configured as relatively tightly packed coils or resistance wire. Consequently, the coil heaters 204-1 and 204-2 have a higher wattage density than the ribbon heating elements 202-1, 202-2 and 202-3. As is known, "wattage density" is the rated wattage of an element per unit of surface heated area (typically, square inches), and indicates the potential to transmit heat.

Advantageously, it is realized in accordance with embodiments of the invention that interspersing coil heaters with ribbon heaters in a hybrid heater assembly provides the lower effective watt density associated with heater assemblies comprising PTC heaters, without the aforementioned disadvantages associated with the PTC heaters. That is, coil heaters are typically resistance wire type heaters which heat up to a desired heat output level within a short time duration from when they are powered on. Relatively speaking, they are considered to heat up to such a desired heat output level instantly or within a period of time which is perceivably negligible to a user (i.e., "instant on" capability). In comparison, PTC heaters controlled by triacs to minimize wattage degradation as described above take longer from power on to heat up to a desired heat output level.

Ribbon heaters are also considered "instant-on" and thus also do not require slow ramp-up triac control to minimize wattage degradation over the life of the heater. But a ribbon heater has a lower wattage density than a coil heater. In accordance with embodiments of the invention, the coil heaters provide "instant on" heating at a higher wattage density and the ribbon heaters with their lower wattage density help diffuse the heat output of the heat assembly to the airstream to achieve a lower uniform wattage density overall for the heater assembly than would otherwise be the case with coil heaters alone. In other words, the ribbon heaters lower the overall wattage density of the heater assembly for improved safety and heat dispersion within the hybrid heater assembly.

Principles of the invention are not limited to the order in which the heaters in the hybrid heater assembly 200 are turned on. Thus, in some embodiments, the coil and ribbon heaters may be powered on at substantially the same time. In other embodiments, the ribbon heaters may be powered on prior to the coil heaters. In still other embodiments, the coil heaters are powered on prior to the ribbon heaters. It is important to note that various other configurations are possible. For example, one coil heater 204-1 and one ribbon heater 202-1 may be powered on, with the remaining heaters (or some subset thereof) being powered on after a predetermined delay period. One skilled in the art will readily appreciate that various other configurations and power-up sequences are possible.

It is to be appreciated that while coil heaters 204-1 and 204-2 are described in this embodiment as nichrome heaters, they could alternatively be formed from any other comparably suitable non-magnetic alloy. The same is the case for the ribbon heaters 202-1, 202-2 and 202-3.

Further, while only three ribbon heaters and two coil heaters are shown in the embodiment of FIG. 2, it is to be understood that hybrid heater assembly embodiments of the invention can include one or more ribbon heaters interspersed with one or more coil heaters.

Note also that the coil heaters 204-1 and 204-2 in the embodiment of FIG. 2 are distributed substantially evenly within the heater assembly 200, i.e., the vertical placement of the ribbon heaters and the nichrome coil heaters alternate (ribbon heater 202-1, coil heater 204-1, ribbon heater 202-2, coil heater 204-2, ribbon heater 202-3). This provides for a substantially even distribution of the instant heat output that is realized when the coil heaters are powered on. In turn, the air conditioning unit in which the heater assembly resides can be fabricated with more polymeric material components/assemblies in place of metal material components/assemblies since the polymeric materials are less likely to melt when the heat is substantially evenly distributed rather than concentrated in one area of the heater assembly. Increased use of polymeric materials reduces the manufacturing cost associated with the unit.

Embodiments of the invention also serve to realize operational efficiencies, as will be described now in the context of FIG. 3.

Figure 3:
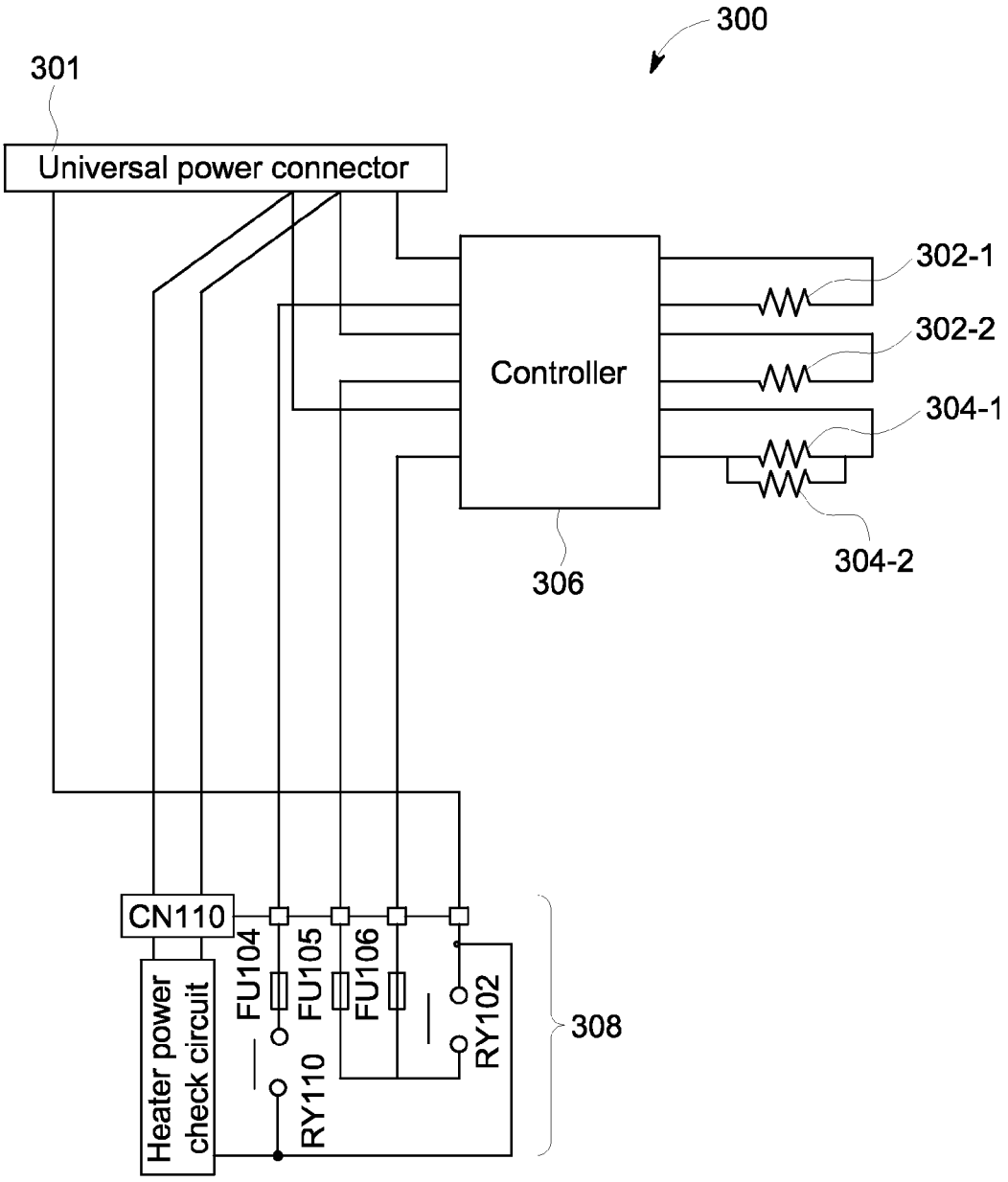
FIG. 3 is a diagram of a schematic of a hybrid heater assembly, in accordance with an embodiment of the invention.

FIG. 3 is a diagram of a schematic of a hybrid heater assembly, in accordance with an embodiment of the invention. The schematic of hybrid heater assembly 300 shown in FIG. 3 corresponds to the hybrid heater assembly 200 described above in FIG. 2.

As shown, the hybrid heater assembly 300 comprises universal power connector 301 (corresponding to connector 110 in FIG. 1), ribbon heater 302-1 (corresponding to ribbon heater 202-1 in FIG. 2), ribbon heater 302-2 (corresponding to ribbon heater 202-2 in FIG. 2), nichrome heater 304-1 (corresponding to coil heater 204-1 in FIG. 2), nichrome heater 304-2 (corresponding to coil heater 204-2 in FIG. 2), a controller 306, and test/fuse circuitry 308. Note that for simplicity and clarity of the FIG. 3 arrangement, a ribbon heater corresponding to ribbon heater 202-3 in FIG. 2 is omitted. One skilled in the art will appreciate that the specific number of ribbon heaters and/or coil heaters in a given hybrid heater assembly may vary.

It is to be appreciated that depending on the power source connected to the universal power connector 301, the heater assembly 300 can draw different current amounts in order to provide different total output heat levels.

Thus, by way of example only, assume that each nichrome heater 304-1 and 304-2 is designed to produce about 1200 Watts (W) of heat output, ribbon heater 302-1 is designed to produce about 1000 W of heat output, and ribbon heater 302-2 is designed to produce about 1400 W of heat output when operated at 230 volts. By selectively powering on one or more of the heaters, different total heat output levels are realized by the heater assembly 300. Selection of the appropriate heater for powering on is controlled by controller 306 (which can be under the control of one or more software programs as further mentioned below).

Again, by way of the example wattages above, operating the two nichrome heaters 304-1 and 304-2 and the ribbon heater (302-1) provides about 3400 W of heat output (2400 W from two nichrome heaters plus 1000 W from the ribbon heater). Alternatively, about 4800 W of heat output are achieved when both ribbon heaters 302-1 (1000 W) and 302-2 (1400 W) are powered on together with the nichrome heaters 304-1 (1200 W) and 304-2 (1200 W).

It is to be appreciated that the above power/current values and the power-on combinations of the various heaters are only illustrative examples, and thus other values and power-on combinations are possible.

Lastly, the test/fuse circuitry 308 shown in FIG. 3 may be conventional circuitry for protecting the air conditioning unit from overheating and otherwise malfunctioning. One of ordinary skill in the art will realize the functions and implementations of such circuitry.

It is to be further appreciated that the air conditioning units and/or heater assemblies described herein may have control circuitry including, but not limited to, a microprocessor (processor) that is programmed, for example, with suitable software or firmware, to implement one or more techniques as described herein. By way of example only, such control circuitry may control cooling and/or heating operations. One example is controller 306 in FIG. 3. In other embodiments, an ASIC (Application Specific Integrated Circuit) or other arrangement could be employed. One of ordinary skill in the art will be familiar with air conditioning units and heater assemblies and given the teachings herein will be enabled to make and use one or more embodiments of the invention; for example, by programming a microprocessor with suitable software or firmware to cause the air conditioning units and heater assemblies to perform illustrative steps described herein. Software includes but is not limited to firmware, resident software, microcode, etc. As is known in the art, part or all of one or more aspects of the invention discussed herein may be distributed as an article of manufacture that itself comprises a tangible computer readable recordable storage medium having computer readable code means embodied thereon. The computer readable program code means is operable, in conjunction with a computer system or microprocessor, to carry out all or some of the steps to perform the methods or create the apparatuses discussed herein. A computer-usable medium may, in general, be a recordable medium (e.g., floppy disks, hard drives, compact disks, EEPROMs, or memory cards) or may be a transmission medium (e.g., a network comprising fiber-optics, the worldwide web, cables, or a wireless channel using time-division multiple access, code-division multiple access, or other radio-frequency channel). Any medium known or developed that can store information suitable for use with a computer system may be used. The computer-readable code means is any mechanism for allowing a computer or processor to read instructions and data, such as magnetic variations on magnetic media or height variations on the surface of a compact disk. The medium can be distributed on multiple physical devices. As used herein, a tangible computer-readable recordable storage medium is intended to encompass a recordable medium, examples of which are set forth above, but is not intended to encompass a transmission medium or disembodied signal. A microprocessor may include and/or be coupled to a suitable memory.

Thus, while there have been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A heater assembly comprising:

a plurality of first heating elements, the plurality of first beating elements being characterized by a first wattage density; and one or more second heating elements, the one or more second heating elements being characterized by a second wattage density, the second wattage density being greater than the first wattage density, wherein the one or more second heating elements are alternately distributed with the plurality of first heating elements, the plurality of first heating elements comprise one or more ribbon heating elements, and the one or more second heating elements comprise one or more coil heating elements.

2. The heater assembly of claim 1, wherein the one or more second heating elements are distributed substantially evenly within the heater assembly.

3. The heater assembly of claim 1, wherein the one or more second heating elements comprise one or more non-magnetic alloy heating elements.

4. The heater assembly of claim 3, wherein the one or more non-magnetic alloy heating elements are formed from nichrome.

5. The heater assembly of claim 1, wherein the plurality of first heating elements and the one or more second heating elements are configured to be selectively powered on to obtain different overall heat output levels for the heater assembly.

6. An air conditioning unit comprising:

a heater assembly comprising:

a plurality of first heating elements, the plurality of first heating elements being characterized by a first wattage density; and one or more second heating elements, the one or more second heating elements being characterized by a second wattage density, the second wattage density being greater than the first wattage density, wherein the one or more second heating elements are alternately distributed with the plurality of first heating elements.

7. The air conditioning unit of claim 6, wherein the one or more second heating elements are distributed substantially evenly within the heater assembly.

8. The air conditioning unit of claim 6, wherein the plurality of first heating elements comprise one or more ribbon heating elements.

9. The air conditioning unit of claim 6, wherein the one or more second heating elements comprise coil heating elements.

10. The air conditioning unit of claim 6, wherein the one or more second heating elements comprise one or more non-magnetic alloy heating elements.

11. The air conditioning unit of claim 10, wherein the one or more non-magnetic alloy heating elements are formed from nichrome.

12. The air conditioning unit of claim 6, further comprising a controller coupled to the heater assembly, the controller controlling the powering on of the plurality of first heating elements and the one or more second heating elements, wherein the plurality of first heating elements and the one or more second heating elements are configured to be selectively powered on under control of the controller to obtain different overall heat output levels for the heater assembly.

13. An air conditioning unit comprising:

a heater assembly comprising:

a set of ribbon heaters; and a set of coil heaters, wherein the coil heaters are alternately distributed with the ribbon heaters; and a controller coupled to the heater assembly, the controller controlling the powering on of the ribbon heaters and the coil heaters.

14. The air conditioning unit of claim 13, wherein the ribbon heaters and the coil heaters are distributed substantially evenly within the heater assembly.

15. The air conditioning unit of claim 13, wherein the heater assembly and the controller are part of a package terminal heat pump unit.

16. The air conditioning unit of claim 13, wherein the heater assembly and the controller are part of a package terminal air conditioner unit.

* * * * *

UNITED STATES PATENT AND TRADEMARK OFFICE

CERTIFICATE OF CORRECTION

PATENT NO. : 9,204,494 B2
APPLICATION NO. : 13/692045
DATED : December 1, 2015
INVENTOR(S) : Robert Jules Lafleur It is certified that error appears in the above-identified patent and that said Letters Patent is hereby corrected as shown below:

In the Claims

Column 6, line 30 in Claim 1, line 3, please delete the word "beating" and replace with the word --heating--

Signed and Sealed this
Eighth Day of March, 2016

Michelle K. Lee

Michelle K. Lee
*Director of the United States Patent and Trademark Office*